United States Patent [19]

Beaven et al.

[11] 4,301,848

[45] Nov. 24, 1981

[54] BAGS FOR CONTAINING BULK MATERIAL

[75] Inventors: John P. Beaven; Beaumont B. Varcoe, both of Par, England

[73] Assignee: English Clays Lovering Pochin & Company, Ltd., St. Austell, England

[21] Appl. No.: 102,757

[22] Filed: Dec. 12, 1979

[30] Foreign Application Priority Data

Dec. 15, 1978 [GB] United Kingdom ..... 48737/78

[51] Int. Cl.[3] ..... B65D 33/02

[52] U.S. Cl. ..... 150/1; 150/12

[58] Field of Search ..... 150/1, 12

[56] References Cited

U.S. PATENT DOCUMENTS 4,010,784 3/1977 Nattrass ..... 150/12 X 4,207,937 6/1980 Sandeman ..... 150/1

4,224,970 9/1980 Williamson ..... 150/1

*Primary Examiner*—Donald F. Norton

*Attorney, Agent, or Firm*—Weingram & Klauber

[57] ABSTRACT

A bag suitable for containing material in bulk comprises a side wall, a bottom panel and a cover, all of woven material. The upper part of the side wall is provided with at least three lifting loops attached to the side wall at locations where the material of the side wall is folded to provide at least two overlapping layers. Each lifting loop comprises an opening and two legs. The two legs are secured together contiguously to form a double thickness which is secured to the overlapping layers, and at least one leg of each of at least two of the lifting loops extends substantially to the bottom of the side wall.

20 Claims, 10 Drawing Figures

BAGS FOR CONTAINING BULK MATERIAL

BACKGROUND OF INVENTION

This invention relates to bags for containing bulk material, particularly, although not exclusively, material which consists of lumps, granules and/or particles which are not larger than 2 centimeters. Such bags may be used, for example, for transporting clay in bulk.

Large bags for containing bulk material are already known but many of these are either very expensive or have a tendency to fail catastrophically when under load, as, for example, when the filled bag is lifted by a crane.

British Patent Nos. 1,431,581 and 1,484,984 describe bags which have four separate lifting loops disposed around the top. Each loop has two legs each of which is secured to the fabric of the bag by folding a portion of the fabric to a substantially S-shaped configuration and then stitching through the three thicknesses of fabric and the leg, which may be placed either on an exposed surface of the folded portion or between the folds. This arrangement has the disadvantage that when the bag is under load the fabric has a tendency to fail catastrophically at or below the level of the lower ends of the legs of the loops, allowing the loaded bag to fall away as a body.

SUMMARY OF INVENTION

According to the present invention there is provided a bag suitable for containing material in bulk, the bag having a mouth and at least three lifting loops, each lifting loop providing an opening adjacent the mouth of the bag and having two legs extending from the opening, the two legs being attached to the bag at a location where the material of the bag is folded to provide at least two overlapping layers of material to which the legs are secured, at least one of the legs of at least two of the lifting loops extending substantially to the bottom of the bag.

The bag may comprise a side wall, a bottom panel and a cover for closing the mouth. The side wall of the bag is conveniently made from a substantially rectangular piece of woven material, opposite edges of which are joined together with at least one row, and preferably two or three rows, of stitching, which stitching also secures the extended leg of one of the lifting loops to the side wall. In this way a strong vertical seam is formed which is additionally reinforced by the material of the extended leg.

The material from which the lifting loops are formed should preferably have a breaking load of at least 2,000 Kg. Although material of circular cross section, such as a rope, may be used for the lifting loops, it is preferred to use a flat material, most preferably a belt of woven material such as woven poly (ethylene terephthalate). The width of the belt is conveniently in the range from about 35 mm to about 75 mm. When the handles are formed of flat material, the double thickness of each lifting loop is made by securing the two legs together face to face with at least two rows of stitches, the same stitches also securing the lifting loop to the fold in the upper part of the side wall.

The side wall, the bottom panel and the cover may be made of woven natural fibre material such as jute, but are preferably made of woven synthetic fibre material such as poly(ethylene terephthalate), rayon, nylon and, most preferably, polypropylene.

The cover is preferably secured to the side wall in such a way that the lower edge region of the cover overlaps the outer surface of the side wall and the upper ends of the folds. Most preferably the edge of the top panel overlaps the side wall by at least 20 mm.

BRIEF DESCRIPTION OF DRAWINGS

For a better understanding of the present invention and to show how it may be carried into effect, reference will now be made, by way of example, to the accompanying drawings, in which.

DESCRIPTION OF PREFERRED EMBODIMENT

Figure 5:
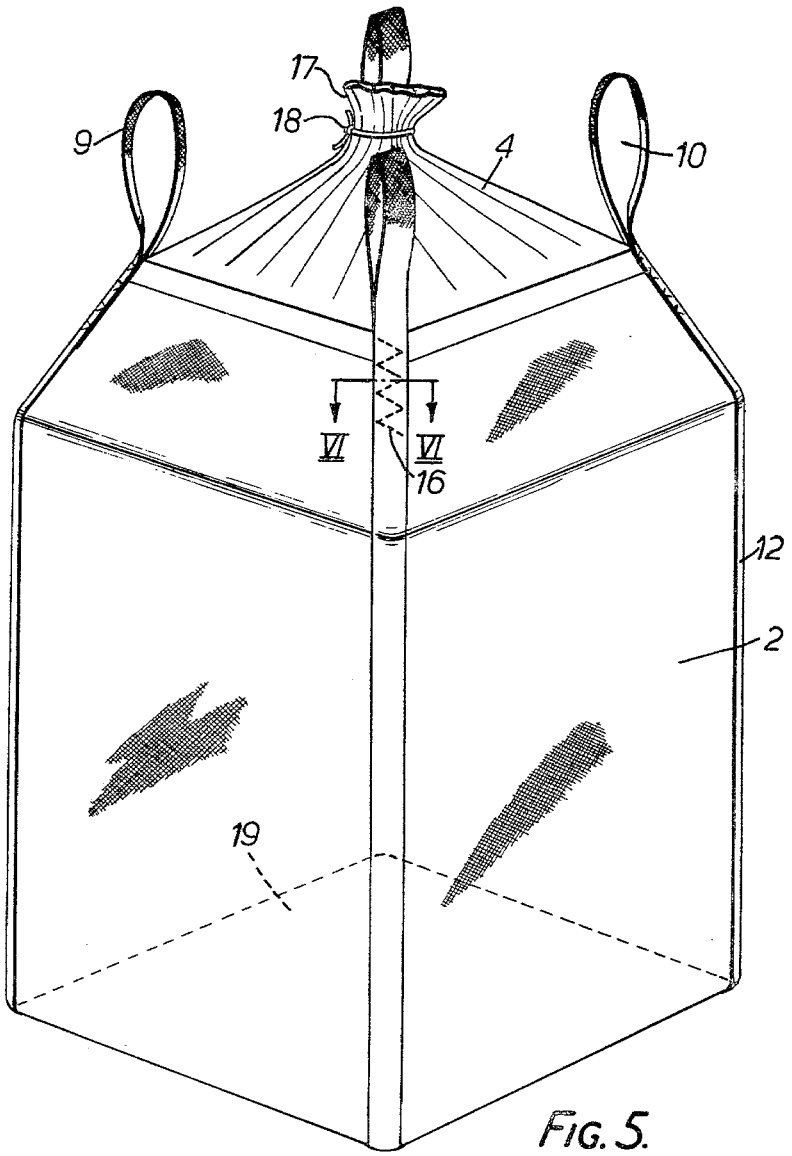
FIG. 5 is a diagrammatic perspective view of the completed bag.

FIG. 5 shows a bag filled with bulk material, such as clay. The bag has a side wall 2 formed from a rectangular piece of woven fabric formed into a tube, the vertical edges of the fabric being sewn together with three rows of stitches. Alternatively, the side wall 2 could be woven as a seamless tube. Four lifting loops 9 are provided at the top of the bag to enable the bag and its contents to be lifted, for example by a crane. The bag has a substantially square bottom panel 19 which is secured inside the lower edge of the side wall 2 by three rows of stitches, the width of the seam being 25 mm. The material in the bag is discharged by cutting a slit in the bottom panel 19. The bag has a cover 4 in the form of a skirt which is stitched to the top edge of the side wall 2. In order to prepare the bag for filling the cover 4 is drawn down over the outside of the side wall 2 and over the lifting loops 9 to leave a large, substantially square opening at the top of the bag. When the bag is full the cover 4 is drawn upwards again and the upper edge gathered together to form a neck 17 which is closed with tapes 18, preferably of synthetic fibre material, stitched into the vertical seam (not shown) of the cover 4.

In an alternative construction, the bottom panel 19 may be made in the form of a skirt of which the lower edge can be gathered together to form a neck and tied in the same manner as for the cover 4. In order to discharge the contents of the bag the tapes around the neck of the bottom skirt may be untied and the skirt then used as a spout to guide the discharging bulk material into a suitable hopper or other container. With this construction, the bag is readily reusable.

The fabric of the side wall 2 is oriented with the weft vertical and the warp horizontal (in the normal upright position of the bag). This orientation of the warp and weft means that the material of the side wall is generally stronger in the horizontal (i.e. warp) direction than it is in the vertical (i.e. weft) direction. Although during lifting the forces in the side wall are mainly in the vertical direction, this orientation is preferred because, if the bag does fail, the threads part slowly instead of breaking suddenly, and a diagonal tear appears across the side wall 2, giving a visible warning of impending failure. The side wall 2 and the bottom panel 19 are made from a woven polypropylene fabric having 15 tapes to the inch (590 tapes to the meter) in the warp direction and 12 tapes to the inch (472 tapes to the meter) in the weft direction.

The top panel is made of a lighter grade of woven polypropylene, "Quality 196". The material for the lifting loops is woven poly (ethylene terephthalate) webbing which is 50 mm wide and has a minimum breaking strength of 2270 Kg.

Steps in the manufacture of the bag of FIG. 5 are illustrated in FIGS. 1 to 4.

Figure 1:
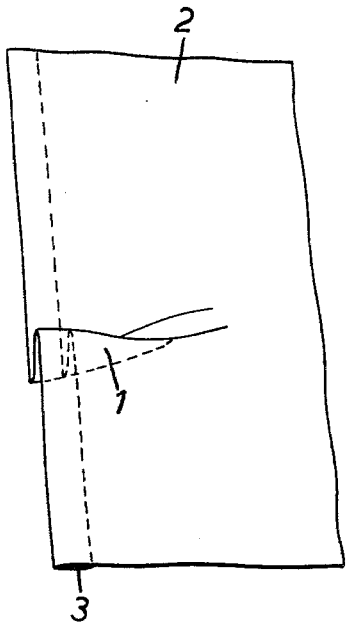
FIGS. 1 to 4 show diagrammatically four different stages in the manufacture of a bag for containing bulk material.

FIG. 1 shows how a pleated fold 1 is formed in the upper region of the side wall 2. The upper edge of the side wall 2 is first turned inwards to form a hem 3 and the fold is then formed by folding the fabric of the side wall 2 in a zig-zag manner as shown. The width of the pleat is conveniently about 50 mm and the length about 300 mm for a bag having a side wall height of 1.370 mm, i.e. the length of the fold is between one quarter and one fifth of the height of the side wall.

Figure 2:
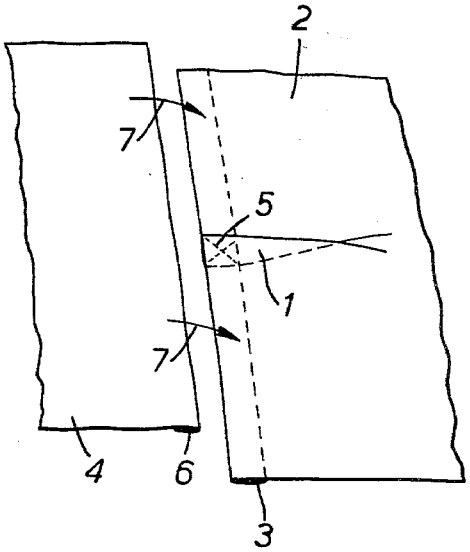

FIG. 2 shows how the material of the cover 4 is laid over the outer side of the top edge of the side wall. The fold 1 is tacked, for example with two crossing rows of stitches 5, the lower edge of the cover 4 is turned inwards to form a hem 6 and the cover 4 is placed over the side wall 2 as shown by the arrows 7.

Figure 3:
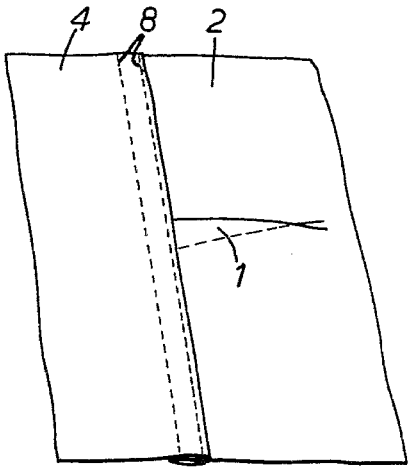

FIG. 3 shows how the cover 4 is secured to the side wall 2 by two rows of stitches 8 which pass through the top of the fold 1 and secure it firmly in place. The cover 4 overlaps the side wall 2 by approximately 20 mm.

Figure 4:
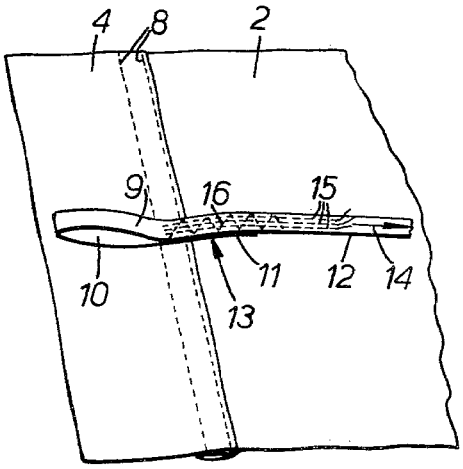

FIG. 4 shows the manner in which a lifting loop 9 is attached to the bag. The lifting loop 9 comprises an opening 10 and two legs 11 and 12. The legs are placed in contact with one another face to face to form a double thickness 13. The leg 12 is longer than the leg 11 and extends substantially to the bottom of the side wall 2 as is indicated by the arrow 14. The double thickness 13 is placed over the fold 1 and the double thickness and the extended leg 12 are sewn to the side wall with three rows of stitches 15. The fold 1 and the seam between the cover 4 and the side wall 2 are further reinforced by a further row of stitches 16 applied in a zig-zag pattern.

Figure 6A:
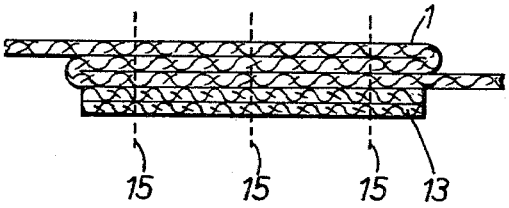
FIGS. 6A, 6B and 6C are sectional views taken on the line VI—VI in FIG. 5, and show three alternative constructions.

FIG. 6A is a section through the legs 11 and 12 of the lifting loop 9 and through the fold 1 and shows the double thickness 13 secured to the exposed outer face of the side wall 2.

Figure 6B:
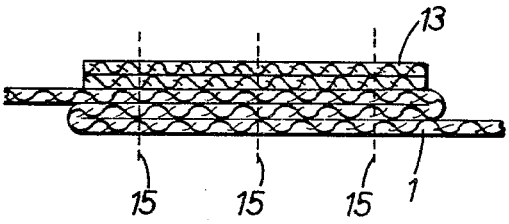

FIG. 6B shows the double thickness 13 secured to the exposed inner face of the side wall 2.

Figure 6C:
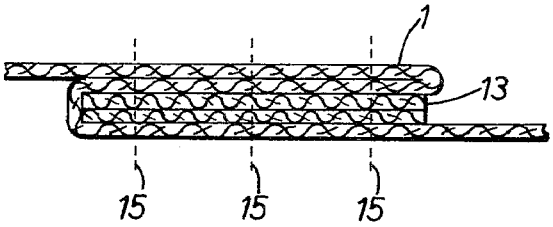

FIG. 6C shows the double thickness 13 secured between the layers of material in the fold 1.

Figure 7:
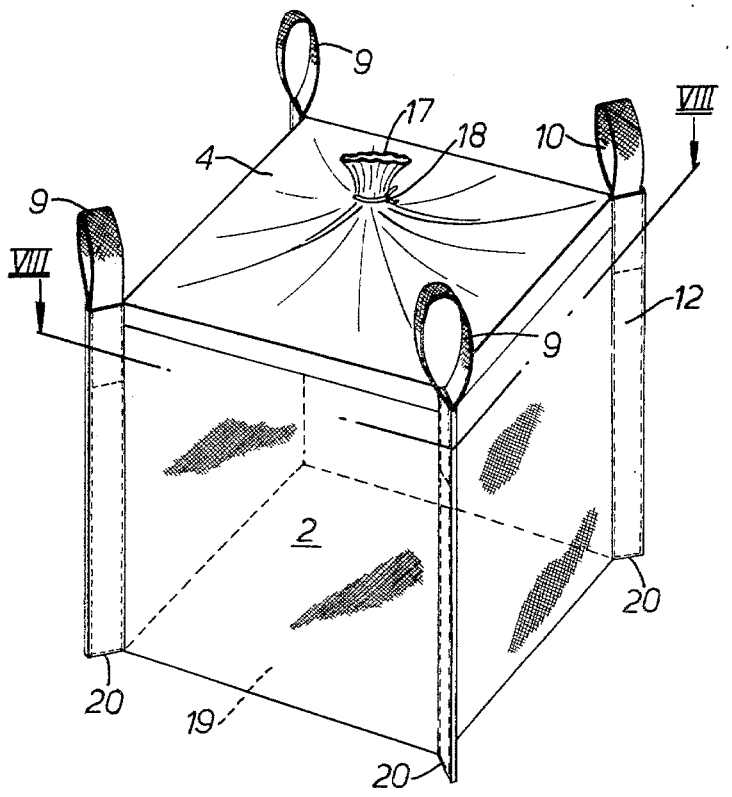
FIG. 7 is a diagrammatic perspective view of another embodiment of bag.
Figure 8:
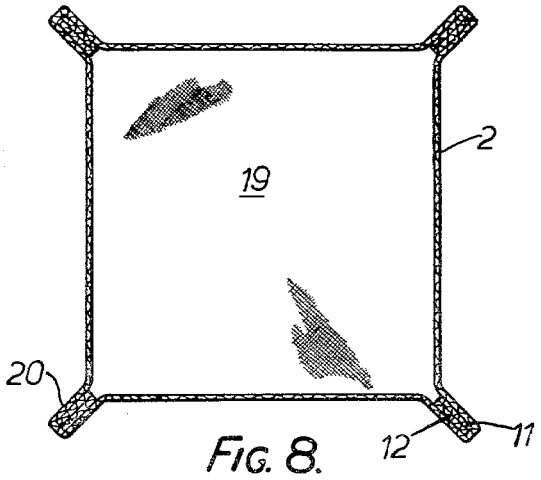
FIG. 8 is a sectional view taken in the plane VIII—VIII in FIG. 7.

FIGS. 7 and 8 show another embodiment of bag. Like the bag of FIG. 5, the bag of FIGS. 7 and 8 has a side wall 2, a bottom panel 19 and a cover 4, having a gathered neck 17 tied by tapes 18. The materials used are the same as for the bag of FIG. 5. As with the bag of FIG. 5, there are four lifting loops 9, each having an opening 10 and legs 11 and 12. The legs 11 and 12 are stitched together to form a double thickness which extends for about one fifth of the height of the side wall 2. From the double thickness, the leg 12 extends to the bottom of the side wall 2.

At the location of each lifting loop 9, the material of the side wall 2 is formed into a fold 20 by folding along a single crease. The fold 20 runs the whole height of the side wall 2. The legs 11 and 12 are positioned between the two layers of material so formed and are secured in position by stitching. The fold 20 is approximately 70 mm wide. One of the folds 20 is formed at the vertical seam where the ends of the material of the side wall 2 are stitched together.

In both embodiments, the fabric may be sealed and waterproofed by applying to it a coat of molten polypropylene. Because the cover 4 extends over the top edge of the side wall 2 and is stitched to the outside of the side wall 2, no upwardly opening gulley is presented by the seam for water to collect in. For the same reason, the bottom panel 19 is stitched to the inside of the side wall 2.

A typical bag having a large enough capacity to contain 1 tonne of bulk lump china clay will have a side wall height of 1.370 meters and a square base of side 915 mm.

Because the legs 12 of the loops extend to the bottom of the side wall 2, failure of the bag in the upper region of the side wall 2 is unlikely. Instead, failure, if it occurs, is most likely to take the form of gradual tearing of the fabric of the side wall 2 or of the bottom panel 19, or parting of the seam between the side wall 2 and the bottom panel 19. Failure of this form will usually result in the material contained in the bag being spilled as a falling stream which would be relatively harmless to people below, compared with the effect of the full bag falling as a result of failure in the upper region of the bag.

We claim:

1. A bag suitable for containing material in bulk, the bag comprising:

a bag portion defining a mouth, and at least three lifting loops, each providing an opening adjacent the mouth of the bag portion and having two legs extending from the opening, both legs of each lifting loop being attached to the bag portion at a location where the material of the bag portion is folded to provide at least three overlapping layers of material to which the legs are secured, at least one of the legs of at least two of the lifting loops extending substantially to the bottom of the bag portion.

2. A bag as claimed in claim 1, in which the two legs of each lifting loop are secured together in contact with one another.

3. A bag as claimed in claim 1, which comprises a side wall extending around the bag portion and a bottom closure secured at the bottom of the side wall, the lifting loops being secured to the side wall.

4. A bag as claimed in claim 3, in which the bottom closure comprises a substantially square bottom panel.

5. A bag as claimed in claim 3, in which the side wall is made of woven material.

6. A bag as claimed in claim 5, in which the woven material of the side wall is oriented with the weft substantially vertical and the warp substantially horizontal, with respect to the upright position of the bag with the mouth at the top and the bottom closure at the bottom.

7. A bag as claimed in claim 5, in which the side wall is made of woven synthetic fibre material.

8. A bag as claimed in claim 7, in which the side wall is made of polypropylene.

9. A bag as claimed in claim 3, in which the side wall comprises a substantially rectangular piece of material joined together end to end by at least one row of stitching to form a tube.

10. A bag as claimed in claim 9, in which the said at least one row of stitching serves to secure the extended leg of one of the lifting loops to the material of the bag portion.

11. A bag as claimed in claim 3, in which the bottom closure is made from woven polypropylene.

12. A bag as claimed in claim 1, in which the legs of each lifting loop are secured to the outer surface of the outermost overlapping layer of the material.

13. A bag as claimed in claim 1, in which the legs of each lifting loop are secured between two of the overlapping layers of material.

14. A bag as claimed in claim 1, in which a cover is provided for closing the mouth of the bag portion.

15. A bag as claimed in claim 14, in which the cover is adapted to be gathered together into a tied neck.

16. A bag as claimed in claim 14, in which the material of the cover overlaps the outer surface of the material of the bag portion.

17. A bag as claimed in claim 1, in which each lifting loop is made of webbing.

18. A bag as claimed in claim 1, in which the material of each lifting loop has a breaking load of at least 2000 kg.

19. A bag as claimed in claim 1, in which the material of the bag is folded to provide overlapping layers of material over at least one tenth of the height of the bag.

20. A bag suitable for containing material in bulk, the bag comprising:

a bag portion defining a mouth, and at least three lifting loops, each providing an opening adjacent the mouth of the bag portion and having two legs extending from the opening, the two legs being attached to the bag portion at a location where the material of the bag portion is folded to provide at least two overlapping layers of material to which the legs are secured, the legs of each lifting loop being secured to the inner surface of the innermost overlapping layer of said material, and at least one of the legs of at least two of the lifting loops extending substantially to the bottom of the bag portion.

* * * * *